US007076331B1

(12) United States Patent
Nagatsuka et al.

(10) Patent No.: US 7,076,331 B1
(45) Date of Patent: Jul. 11, 2006

(54) ROBOT, METHOD OF ROBOT CONTROL, AND PROGRAM RECORDING MEDIUM

(75) Inventors: Norio Nagatsuka, Kanagawa (JP); Makoto Inoue, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/701,254

(22) PCT Filed: Nov. 30, 1999

(86) PCT No.: PCT/JP99/06713

§ 371 (c)(1),
(2), (4) Date: Nov. 27, 2000

(87) PCT Pub. No.: WO00/32361

PCT Pub. Date: Jun. 8, 2000

(30) Foreign Application Priority Data

Nov. 30, 1998 (JP) ..... P10-340716

(51) Int. Cl.
*G06F 19/00* (2006.01)

(52) U.S. Cl. ..... 700/245; 700/247; 700/258; 700/259; 318/568.12

(58) Field of Classification Search ..... 700/245, 700/247, 259, 258; 318/568.12
See application file for complete search history.

(56) References Cited

U.S. PATENT DOCUMENTS 4,657,104 A * 4/1987 Holland ..... 180/211
5,367,454 A 11/1994 Kawamoto et al.
5,963,712 A * 10/1999 Fujita et al. ..... 318/568.12
6,038,493 A * 3/2000 Tow ..... 700/259
6,058,385 A * 5/2000 Koza et al. ..... 706/13
6,249,780 B1 * 6/2001 Mizokawa ..... 706/23
6,275,773 B1 * 8/2001 Lemelson et al. ..... 340/436
6,321,140 B1 * 11/2001 Fujita et al. ..... 250/253

FOREIGN PATENT DOCUMENTS

JP 62-24988 2/1987
JP 6-12401 1/1994
JP 10-235019 9/1998
JP 10-289006 10/1998

OTHER PUBLICATIONS

Breazeal et al., Infant-like social interactions between a robot and a human caregiver, 1998, Internet, p.1-p.44.*
Hara et al. Real-time facial interaction between human and 3D face robot agent, 1996, Internet/IEEE, pp. 401-409.*

(Continued)

*Primary Examiner*—Thomas G. Black
*Assistant Examiner*—McDieunel Marc
(74) *Attorney, Agent, or Firm*—Rader, Fishman & Grauer PLLC; Ronald P. Kananen

(57) ABSTRACT

When information is inputted from the recognition object, the emotion module discriminates the type of the inputted information (step ST1) and changes the emotion level of each emotion unit using the parameter corresponding to the inputted information (step ST2). The emotion module selects the emotion unit having the maximum emotion level from among the emotion units having the emotion levels exceeding the threshold value. The selected emotion unit notifies the object that is requesting the output, for example, the behavior-production object, of that information.

93 Claims, 9 Drawing Sheets

OTHER PUBLICATIONS

Masahiro Fujita, *Robot Entertainment: Small Four-legged Automatic Robot*, Transactions of Japan Robot Society, Apr. 15, 1998, vol. 16, No. 3, p. 31-31.

Masahiro Fujita, et al., *Robot Entertainment*, Proceedings of the 6th Sony Research Forum, Nov. 27, 1996, p. 234-239.

Tesuya Ogata, et al, *Emotional Model and Internal Symbol Acquisition Model Based on Actions of the Robot*, Proceedings distributed at Lecture Meeting on Robotics and Mechatronics prepared by Japan Machinery Society, Jun. 26, 1998, vol. 1998, No. Ptl, p. 2CII4.3(1)-2CII4.3(2).

Shusuke Mogi, et al., *Basic Research on Artificial Psychology Model*, Printings at 15th study meeting by Human Interface and Cognitive Model Research Group, Artificial Intelligence Society, Jan. 24, 1992, p. 1-8.

Hirohide Ushida, et al., *Emotional Model Application to Pet Robot*, Proceedings distributed at Lecture Meeting on Robotics and Mechatronics prepared by Japan Machinery Society, Jun. 26, 1998, vol. 1998, No. PT1, p. 2CII4.5(1)-2CII4.5(2).

Masahiro Fujita, et al., *Reconfiguration Physical Agents*, Proceedings of the Second International Conference on Autonomous Agents, May 9, 1998, p. 54-61.

* cited by examiner

ROBOT, METHOD OF ROBOT CONTROL, AND PROGRAM RECORDING MEDIUM

TECHNICAL FIELD

This invention relates to a robot device which acts naturally like a living body, a control method for a robot device, and a program recording medium.

BACKGROUND ART

Conventionally, there have been developed robot devices in the shape of a multi-limb living animal, such as a dog or a cat. Such conventionally proposed robot devices are programmed simply to keep doing predetermined works or can only behave in accordance with a simple sequence.

In some portable terminals, virtual pets having emotion models are provided. However, such virtual pets cannot live in the actual world and, therefore, lack reality and a sense of living.

DISCLOSURE OF THE INVENTION

In view of the foregoing status of the art, it is an object of the present invention to provide a robot device which can act with reality and a sense of living in the actual world, a control method for a robot device, and a program recording medium.

A robot device according to the present invention includes: an emotion module in which a plurality of emotion units representing various emotions affect one another to output an emotion; and, action means for acting on the basis of the emotion outputted by the emotion module.

This robot device behaves naturally, like a living body having reality and a sense of living, on the basis of the output of the emotion module including a plurality of emotion units.

A control method for a robot device according to the present invention includes: an emotion-output step of outputting an emotion as a plurality of emotion units representing various emotions that affect one another; and an action-control step of controlling the action of the robot device on the basis of the emotion outputted at the emotion-output step.

In this control method for a robot device, a robot device which behaves naturally like a living body having reality and a sense of living is controlled on the basis of the output at the emotion-output step using a plurality of emotion units.

A program recording medium according to the present invention has recorded therein a program for carrying out: an emotion-output step of outputting an emotion as a plurality of emotion units representing various emotions that affect one another; and an action-control step of controlling the action of the robot device on the basis of the emotion outputted at the emotion-output step.

In this program recording medium, a robot device which behaves naturally, like a living body having reality and a sense of living, is controlled on the basis of the output at the emotion-output step using a plurality of emotion units.

Also, a robot device according to the present invention includes: an instinct module in which a plurality of instinct units representing various instincts output individual instincts; and an action means for acting on the basis of the instinct outputted by the instinct module.

This robot device behaves naturally, like a living body having reality and a sense of living, on the basis of the output of the instinct module including a plurality of instinct units.

A control method for a robot device according to the present invention includes: an instinct output step of outputting an instinct as a plurality of instinct units representing various instincts that affect one another; and an action-control step of controlling the action of the robot device on the basis of the instinct outputted at the instinct output step.

In this control method for a robot device, a robot device which behaves naturally, like a living body having reality and a sense of living, is controlled on the basis of the output at the instinct output step using a plurality of instinct units.

A program recording medium according to the present invention has recorded therein a program for carrying out: an instinct output step of outputting an instinct as a plurality of instinct units representing various instincts that affect one another; and an action-control step of controlling the action of the robot device on the basis of the instinct outputted at the instinct output step.

In this program recording medium, a robot device which behaves naturally like a living body having reality and a sense of living is controlled on the basis of the output at the instinct output step using a plurality of instinct units.

Also, a robot device according to the present invention includes: an emotion module in which a plurality of emotion units representing emotions output individual emotions; an instinct module in which a plurality of instinct units representing instincts output individual instincts; and, an action means for acting on the basis of the emotion outputted by the emotion module and the instinct outputted by the instinct module.

This robot device behaves naturally, like a living body having reality and a sense of living, on the basis of the output of the emotion module including a plurality of emotion units and the output of the instinct module including a plurality of instinct units.

A control method for a robot device according to the present invention includes: an emotion-output step of outputting individual emotions by a plurality of emotion units representing emotions; an instinct output step of outputting individual instincts by a plurality of instinct units representing instincts; and an action-control step of controlling the action of the robot device on the basis of the emotion outputted at the emotion-output step and the instinct outputted at the instinct output step.

In this control method for a robot device, a robot device which behaves naturally, like a living body having reality and a sense of living, is controlled on the basis of the output at the emotion-output step using a plurality of emotion units and the output at the instinct output step using a plurality of instinct units.

A program recording medium according to the present invention has recorded therein a program for carrying out: an emotion-output step of outputting individual emotions by a plurality of emotion units representing emotions; an instinct output step of outputting individual instincts by a plurality of instinct units representing instincts; and, an action-control step of controlling the action of the robot device on the basis of the emotion outputted at the emotion-output step and the instinct outputted at the instinct output step.

In this program recording medium, a robot device which behaves naturally, like a living body having reality and a sense of living is controlled on the basis of the output at the emotion-output step using a plurality of emotion units and the output at the instinct output step using a plurality of instinct units.

BEST MODE FOR CARRYING OUT THE INVENTION

A preferred embodiment of the present invention will now be described in detail with reference to the drawings.

Figure 1:
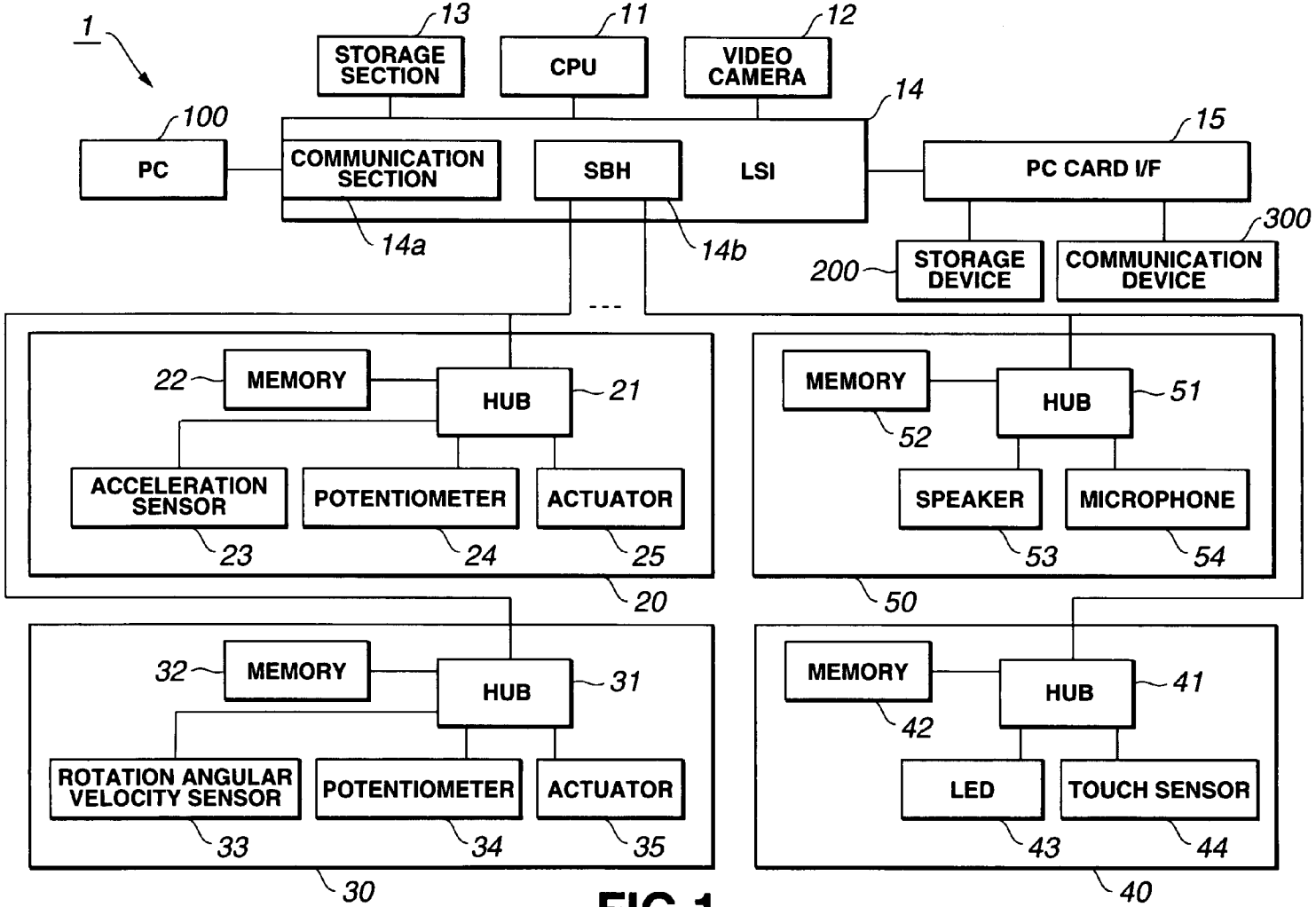
FIG. 1 is a block diagram showing the structure of a robot device according to the present invention.

The present invention is applied to a robot device 1 having the structure as shown in FIG. 1.

The robot device 1 includes a central processing unit (hereinafter referred to as CPU) 11 for controlling the entire system, a video camera 12 having a CCD (charge coupled device) image sensor, a storage section 13 for storing video data from the video camera 12, and a large-scale integrated circuit (hereinafter referred to as LSI) 14 which collectively includes a host controller of a serial bus and the like.

The LSI 14 has a communication section 14*a* constituted by an interface for serial communication, parallel communication or USB communication, and is connected to an external personal computer 100 via the communication section 14*a*. In this case, the personal computer 100 can change a program for causing the CPU 11 to operate or can manipulate the CPU 11 via the LSI 14.

The LSI 14 has a PC card interface 15 and is thus connected to various devices of the PC card standard, for example, a storage device 200, such as an ATA (advanced technology attachment) flash memory card, and a communication device 300, such as a radio communication card.

In the storage device 200, various parameters for controlling the emotion level of emotion units and the instinct level of instinct units are stored. Specifically, an emotion parameter, an input action parameter, an attenuation parameter, an interaction parameter and the like, which are elements for changing and controlling the emotion level of the emotion units are stored. Also, an instinct parameter, an input action parameter, an increase parameter and the like, which are elements for changing and controlling the instinct level of the instinct units are stored. At the time of execution, these parameters are read out and used from the storage device 200.

The LSI 14 has a timer, not shown, for obtaining real-time information, and a battery manager, not shown, for managing the remaining quantity of the battery and carrying out control in cooperation with the timer so as to turn on the power at a certain time point.

The robot device 1 also has first to fourth CPC (configurable physical component) devices 20, 30, 40 and 40, which constitute limbs, ears and mouth. Each CPC device is connected to a serial bus hub (SBH) 14*b* in the LSI 14. While the four CPC devices are shown in this embodiment, it is a matter of course that the number of CPC devices is not particularly limited.

The first CPC device 20 has a hub 21 for controlling each circuit within the device in response to a control command from the LSI 14, a memory 22 for temporarily storing a control signal and a detection signal, an acceleration sensor 23 for detecting the acceleration, a potentiometer 24, and an actuator 25 which serves as a junction or the like. The acceleration sensor 23 detects the acceleration in three axial directions by several ten milliseconds and supplies the results of detection to the CPU 11 via the hub 21 and the serial bus hub 14*b*.

The second CPC device 30 has a hub 31, a memory 32, a rotation angular velocity sensor 33 made up of a gyro sensor for detecting the rotation angular velocity, a potentiometer 34, and an actuator 35. The rotation angular velocity 33 detects the rotation angular velocity in three angular directions by several ten milliseconds and supplies the results of detection to the LSI 14 via the hub 31 and the serial bus hub 14*b*.

The third CPC device 40 has a hub 41, a memory 42, a light-emitting diode (LED) 43 for emitting a light to indicate the reception of an external stimulus, and a touch sensor 44 for detecting whether the exterior is touched or not.

The fourth CPC device 50 has a hub 51, a memory 52, a speaker 53 which serves as a "mouth" for outputting a sound to the outside, and a microphone 54 which serves as an "ear" for detecting an external sound.

The appearance of the robot device 1 is the shape of a multi-limb walking robot. Specifically, the robot device 1 is a multi-joint robot of a multi-limb walking type and is in the shape of an animal having four limbs. However, the robot device is not limited to this. For example, a multi-joint robot of a two-limb walking type may also be used.

The acceleration sensor 23 detects the acceleration with respect to the directions of the X-axis, the Y-axis and the Z-axis. The rotation angular velocity sensor 33 detects the rotation angular velocity with respect to angle R, angle P and angle Y for rotations about the X-axis, the Y-axis and the Z-axis as rotation axes.

Figure 2:
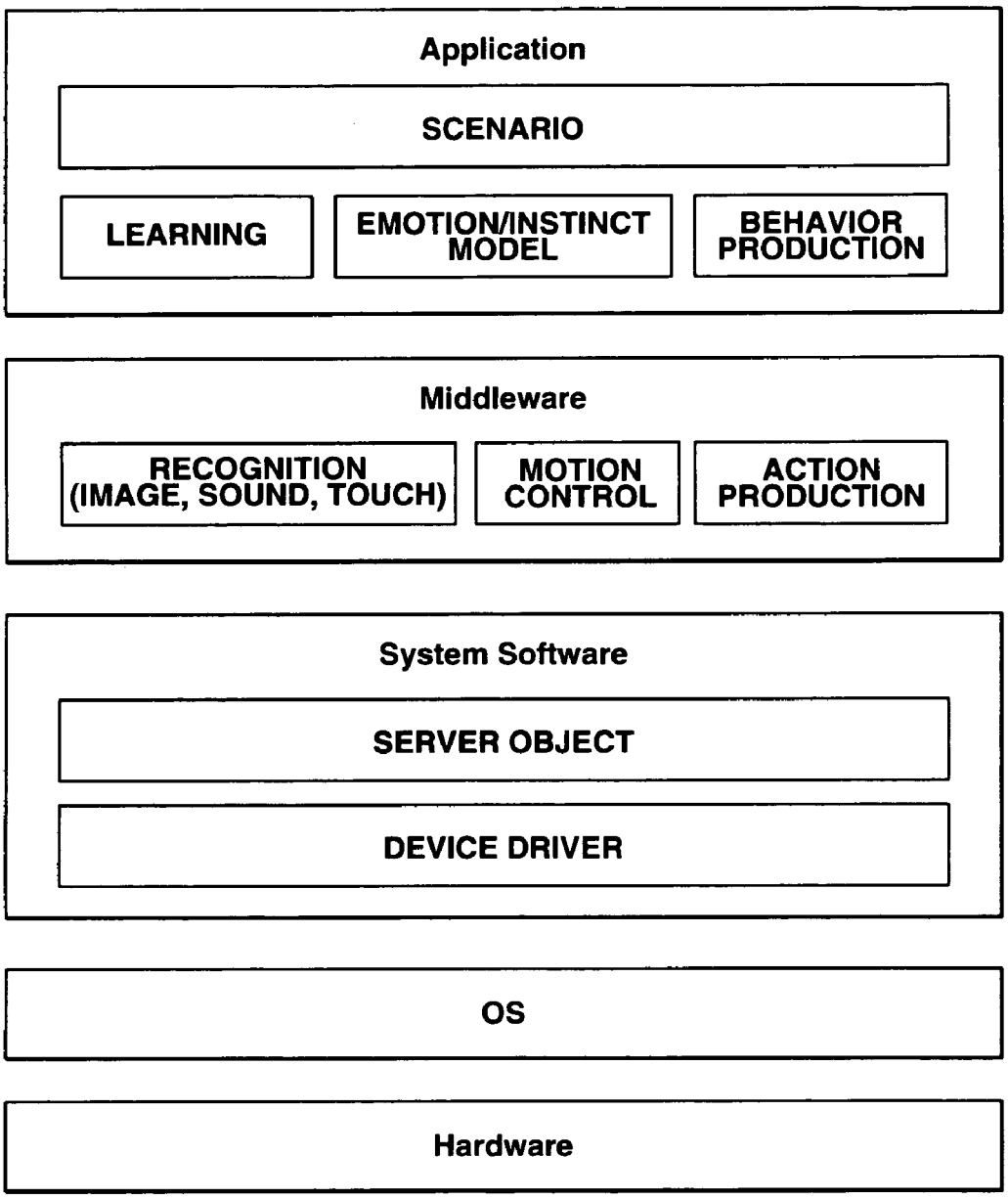
FIG. 2 shows the configuration of a program for controlling the robot device.

A program for controlling the robot device 1 is designed in a hierarchical configuration, as shown in FIG. 2. Specifically, the program is configured by forming three layers consisting of the system software, the middleware and the application on the embedded real-time OS (operating system) which operates on the hardware of the above-described structure.

The system software layer includes a device driver for directly controlling the device and a server object for providing a service to objects of upper layers.

The middleware layer includes a recognition object for processing sensor information such as image, sound and touch, a motion control object for controlling the motion of the robot, such as walking and posture, and an action production object for moving the limbs, head and tail to express actions.

The application layer includes a learning object for learning, an emotion/instinct model object for handling emotions and instincts, a behavior-production object for determining the behavior, and a scenario object for characterizing the entire robot device.

The emotion/instinct model object includes an emotion module and an instinct module.

The emotion module handles a plurality of types of emotion units as data. An emotion unit is constituted by a current level of emotion (hereinafter referred to as emotion level), a minimum emotion level, a maximum emotion level, and a threshold value as a reference for notification of the emotion. The emotion units are prepared corresponding to the types of emotions to be handled, including emotions such as delight, grief, anger, horror, surprise and hatred. The emotion level of each of these emotions is first initialized by the value of an emotion parameter and then is varied in accordance with external information from the recognition object or the like and with the lapse of time.

The respective emotion units have such a nature as to affect one another by mutually enhancing or lowering the emotion levels. For example, when the emotion unit of grief has a high emotion level, the emotion unit of anger also has a high emotion level. When the emotion unit of delight has a high emotion level, the emotion units of anger and hatred have low emotion levels. The above-described emotion units are only typical examples, and this invention is not limited to these examples.

The instinct module handles instinct units as data, similarly to the emotion module.

An instinct unit is constituted by a current level of instinct (hereinafter referred to as instinct level), a minimum instinct level, a maximum instinct level, and a threshold value as a reference for notification of the instinct. The instinct units are prepared corresponding to the types of instincts to be handled, including instinctive desires, such as a desire to eat, desire to exercise, desire to rest, desire for affection, desire to learn and sexual desire. The instinct level of each of these instincts is first initialized by the value of an instinct parameter and then is varied in accordance with external information from the recognition object or the like and with the lapse of time. Unlike the emotion units, the instinct units do not mutually enhance the instinct levels. However, the instinct module and the emotion module may affect each other. For example, when the robot device "feels hungry" in terms of the instinct, it is likely to be "angry" as an expression of the emotion.

The above-described objects are configured by an object-oriented design. Regardless of an upper layer or a lower layer, the state of an object is changed in accordance with the reception of information from another object, and the information corresponding to its own state is outputted to another object. That is, the objects mutually communicate information and affect one another. As such objects, various elements related to the behaviors of a living body can be applied, such as the elements of behaviors of a living body (e.g., learning, thinking, recognition) and the means for performing the behaviors of a living body (limbs, joints, motion control).

The behavior based on the output of the emotion module will now be described.

In the emotion module, the emotion level of each emotion unit may be changed by inputting external information or may change by itself with the lapse of time.

Figure 3:
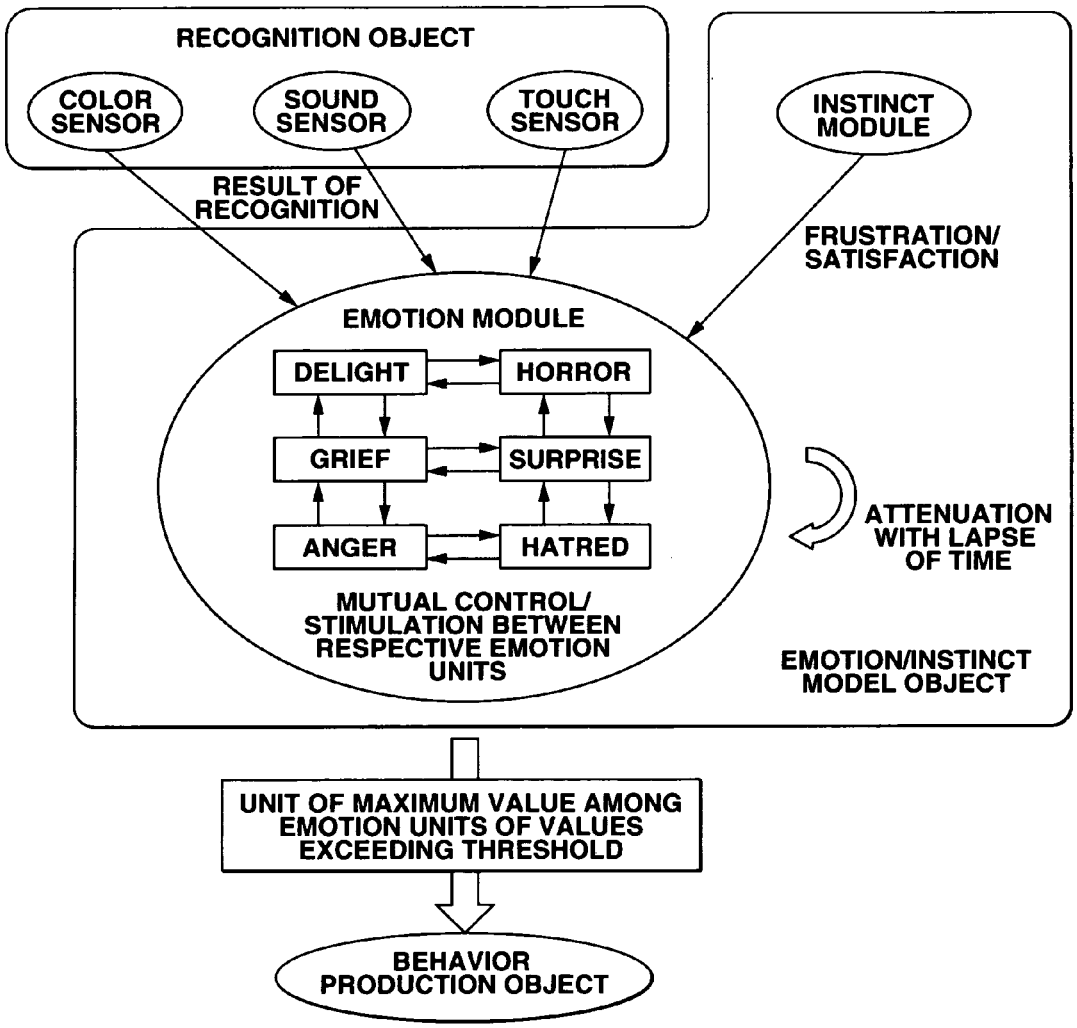
FIG. 3 illustrates the relation between an emotion module and other objects.

First, the above-described recognition object handles input information, such as color information of an image from a color sensor, sound information of the speaker from a sound sensor and touch information from a touch sensor, as various sensor information of the first to fourth CPC devices 20, 30, 40, 50, which are hardware, as shown in FIG. 1. On recognizing information to be notified of, the recognition object notifies the emotion module of the emotion/instinct model object of the information of the result of recognition, as shown in FIG. 3.

Figure 4:
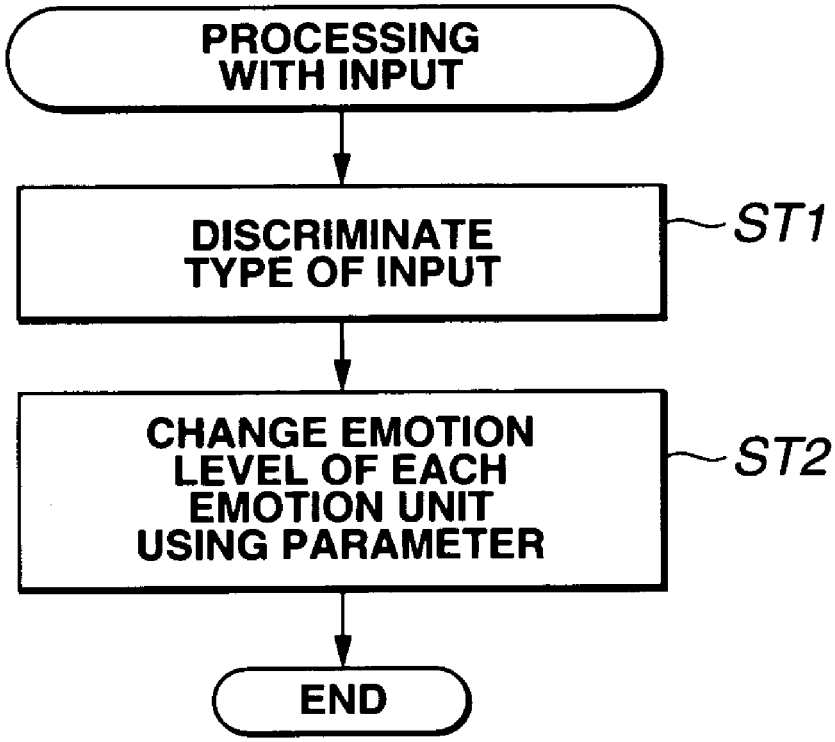
FIG. 4 is a flowchart for explaining the operation in the case where external information is entered to the emotion module.

When the information is inputted from the recognition object, the emotion module discriminates the type of the inputted information (step ST1) and changes the emotion level of each emotion unit using the parameter corresponding to the inputted information (step ST2), as shown in FIG. 4. Then, the emotion module selects the emotion unit having the maximum emotion level from among the emotion units having the emotion levels exceeding the threshold value. The selected emotion unit notifies the object which is requesting the output, for example, the behavior-production object, of that information. The object which is requesting the output must register itself as an observer to the emotion module, using an object-oriented observer pattern. The emotion module may accept an input from an object which does not directly handle the sensor information, for example, by accepting a message to the effect that the instinct module has solved frustration.

The behavior-production object controls the hardware via the action production object or the like. Specifically, the behavior-production object controls the first to fourth CPC devices 20, 30, 40, 50 shown in FIG. 1 so as to take actions using the limbs, head and tail, generate sounds, and flash the LED, thereby expressing emotions.

Figure 5:
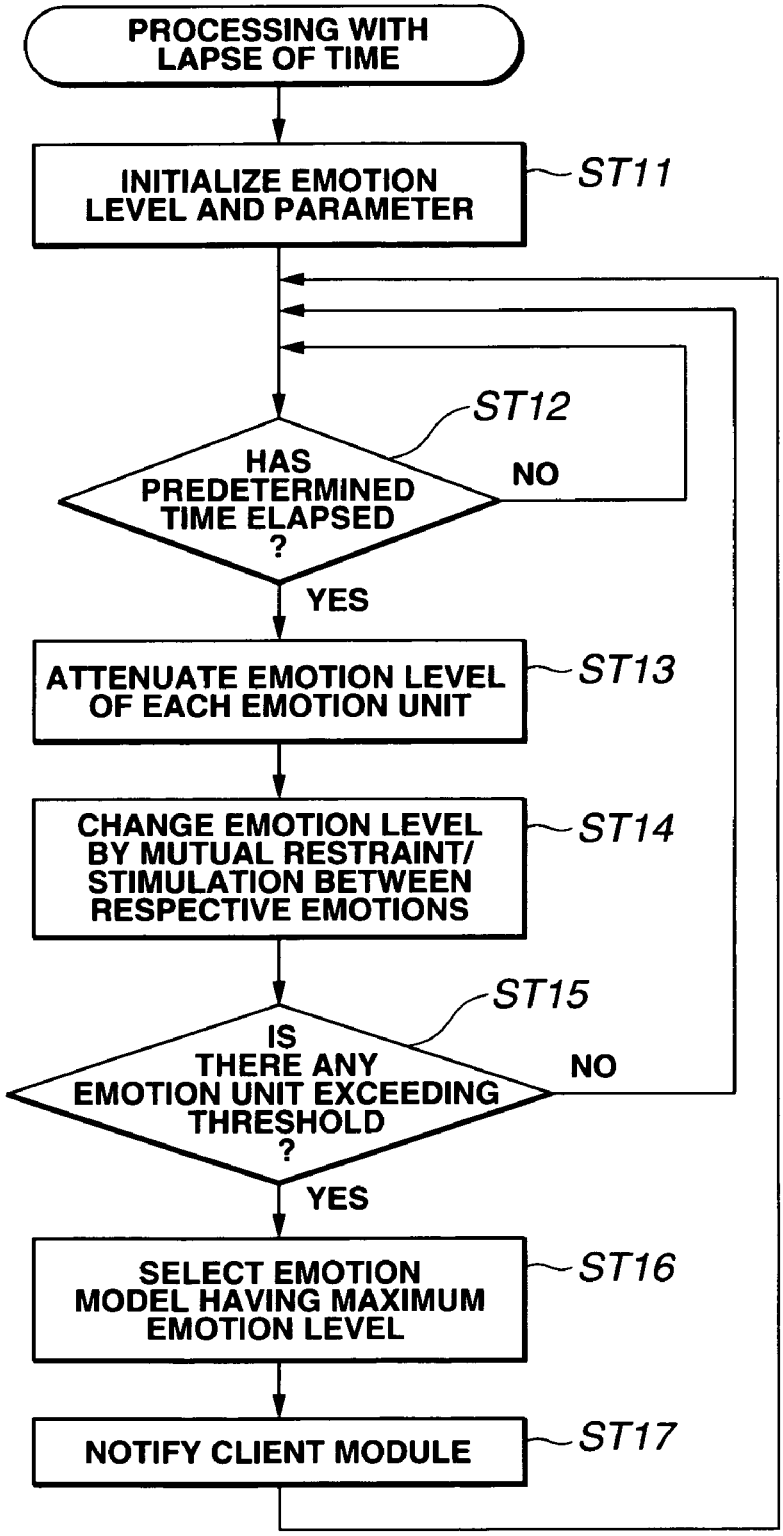
FIG. 5 is a flowchart for explaining the state where the emotion module changes with the lapse of time.

Meanwhile, as the time elapses, the emotion module carries out the processing of step ST11 and the subsequent steps shown in FIG. 5.

At step ST11, the emotion module initializes the emotion level and parameter and then proceeds to step ST12.

At step ST12, the emotion module discriminates whether a predetermined time has elapsed or not, using the timer provided in the LSI 14. If the predetermined time has not elapsed, the emotion module waits at step ST12. If the predetermined time has elapsed, the emotion module proceeds to step ST13.

At step ST13, the emotion module attenuates the emotion level of each emotion unit and proceeds to step ST14. The degree of attenuation is determined by an attenuation parameter stored in the storage section 13.

At step ST14, the emotion module changes the emotion level by mutual restraint/simulation of the respective emotions and proceeds to step ST15. For example, increased horror reduces delight, and increased hatred increases anger. The relation and degree of interaction is determined by a mutual parameter stored in the storage section 13.

At step ST15, the emotion module discriminates whether there is any emotion unit having an emotion level exceeding the threshold value. If there is no such emotion unit, the emotion module returns to step ST12. If there is such an emotion unit, the emotion module proceeds to step ST16.

At step ST16, the emotion module selects the emotion unit having the maximum emotion level from among the emotion units having the emotion levels exceeding the threshold value and then proceeds to step ST17.

At step ST17, the emotion module notifies the behavior-production object of the information of the selected emotion unit. The selected emotion unit notifies the object which is requesting the output, for example, the behavior-production object, of that information. The emotion module may accept an input from an object which does not directly handle the sensor information, for example, by accepting a message to the effect that the instinct module has solved frustration.

The behavior-production object controls the hardware via the action production object or the like. Specifically, the behavior-production object controls the first to fourth CPC devices 20, 30, 40, 50 shown in FIG. 1 so as to take actions using the limbs, head and tail, generate sounds, and flash the LED, thereby expressing emotions. Then, the emotion module returns to step ST12 again.

As the emotion module thus notifies another object of the information of the emotion unit having the maximum emotion level, from among the emotion units having the emotion levels changed by external information or internal changes, the behavior-production object can be notified of the state where various emotions get complicated with one another. On the basis of the information from the emotion module, the behavior-production object controls the first to fourth CPC devices 20, 30, 40, 50, which are hardware, via the system software and OS.

As described above, in the robot device 1, since the emotion module notifies the behavior-production object of the information of the emotion unit having the highest emotion level when various emotions are organically associated with one another in a complicated manner, the optimum emotional expression corresponding to the status can be realized.

In addition to the emotion module which reacts to the input from the external world, the robot device 1 has the instinct module in which desires are gradually increased from inside. Thus, behavior based on the output of the instinct module will now be described.

In the instinct module, the instinct level of each instinct unit may be changed by inputting external information or may be changed by itself with the lapse of time.

Figure 6:
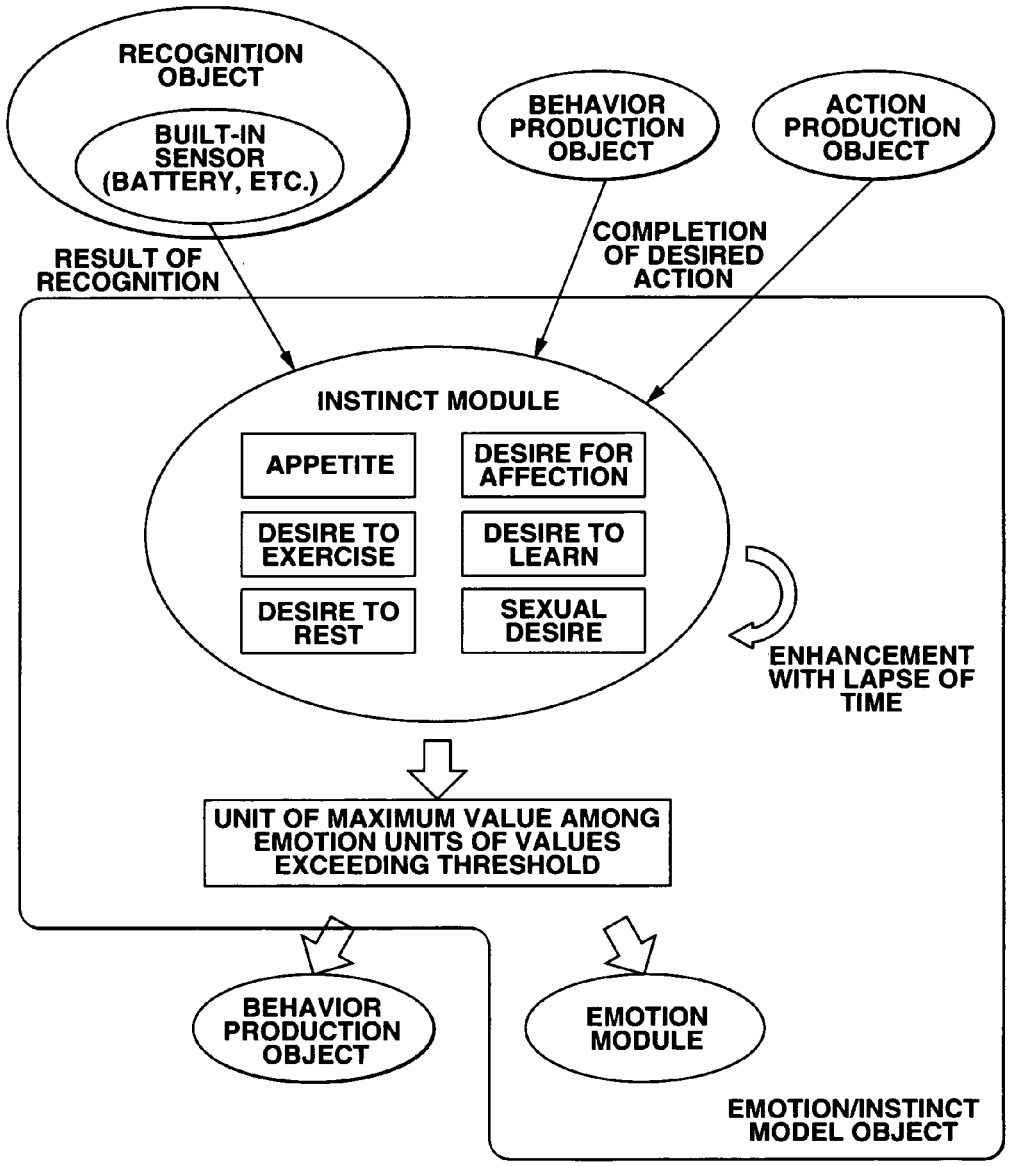
FIG. 6 illustrates the relation between an instinct module and other objects.

First, the above-described recognition object handles input information, such as color information of an image from a color sensor, sound information of the speaker from a sound sensor and touch information from a touch sensor, as various sensor information of the first to fourth CPC devices 20, 30, 40, 50, which are hardware, as shown in FIG. 1. On recognizing information to be notified of, the recognition object notifies the instinct module of the emotion/instinct model object of the information of the result of recognition, as shown in FIG. 6.

Figure 7:
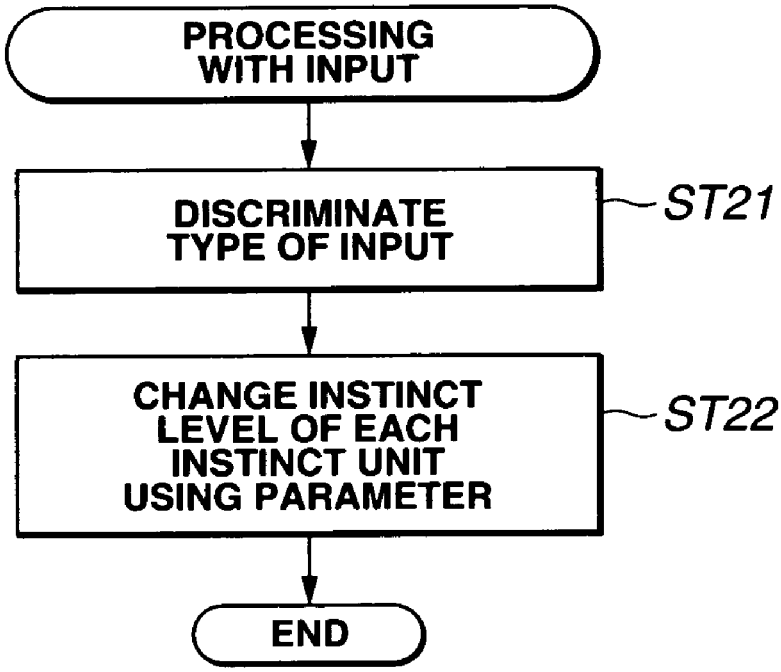
FIG. 7 is a flowchart for explaining the operation in the case where external information is entered to the instinct module.

When the information is inputted from the recognition object, the instinct module discriminates the type of the inputted information (step ST21) and changes the instinct level of each instinct unit using the parameter corresponding to the inputted information (step ST22), as shown in FIG. 7. For example, when the remaining battery capacity is reduced, the instinct level of the instinct unit of appetite is increased and the desire to eat/drink, for example, the request for charging is increased. The instinct module may accept information outputted from an object which does not handle the information from the various sensors, for example, information outputted from the behavior-production module or the action production module on completion of the desired behavior. For example, when the instinct module is notified of the end of hard exercise, the instinct level of desire to exercise is significantly attenuated.

The instinct module selects the instinct unit having the maximum instinct level from among the instinct units having the instinct levels exceeding the threshold value. The selected instinct unit notifies the object which is requesting the output, for example, the behavior-production object, of that information. The object which is requesting the output must register itself as an observer to the instinct module, using an object-oriented observer pattern.

The behavior-production object controls the hardware via the action production object or the like. Specifically, the behavior-production object controls the first to fourth CPC devices 20, 30, 40, 50 shown in FIG. 1. For example, the behavior-production object causes the limbs, head and tail to move so as to perform hard exercise when the desire to exercise is enhanced and so as to rest when the desire to rest is enhanced, thereby expressing instincts.

Figure 8:
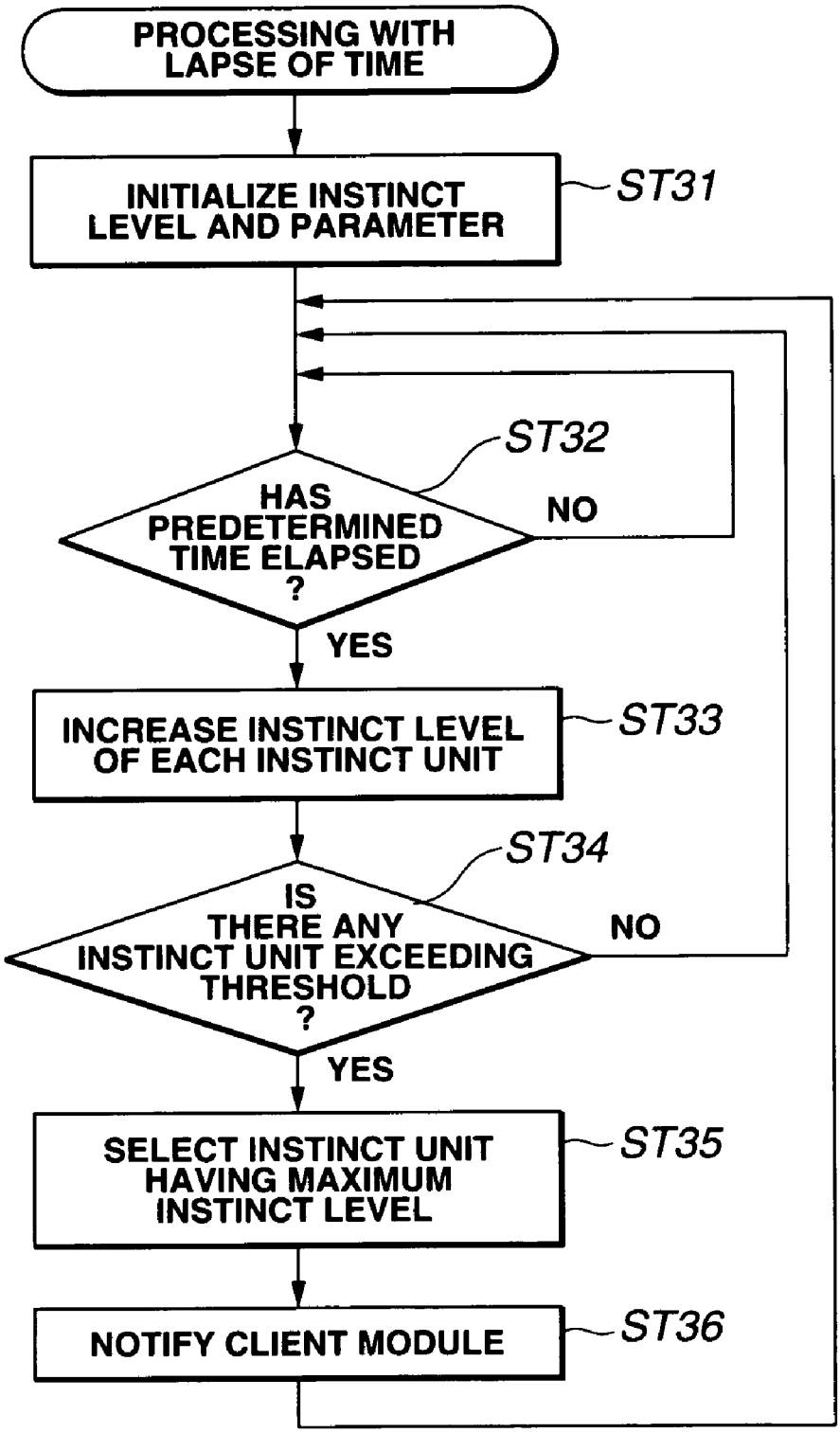
FIG. 8 is a flowchart for explaining the state where the instinct module changes with the lapse of time.

Meanwhile, as the time elapses, the instinct module carries out the processing of step ST31 and the subsequent steps shown in FIG. 8.

At step ST31, the instinct module initializes the instinct level and parameter and then proceeds to step ST32.

At step ST32, the instinct module discriminates whether a predetermined time has elapsed or not, using the timer provided in the LSI 14. If the predetermined time has not elapsed, the instinct module waits at step ST32. If the predetermined time has elapsed, the instinct module proceeds to step ST33.

At step ST33, the instinct module increases the instinct level of each instinct unit and proceeds to step ST34. The degree of increase is determined by an increase parameter stored in the storage section 13.

At step ST34, the instinct module discriminates whether there is any instinct unit having the instinct level exceeding the threshold value. If there is no such instinct unit, the instinct module returns to step ST32. If there is such an instinct unit, the instinct module proceeds to step ST35.

At step ST35, the instinct module selects the instinct unit having the maximum instinct level from among the instinct units having the instinct levels exceeding the threshold value and then proceeds to step ST36.

At step ST36, the instinct module notifies the client module, such as the behavior-production object of the information of the selected instinct unit. The selected instinct unit notifies the object which is requesting the output, for example, the behavior-production object, of that information.

The behavior-production object controls the hardware via the action production object or the like and then returns to step ST32.

As the instinct module thus notifies another object of the information of the instinct unit having the maximum instinct level, from among the instinct units having the instinct levels changed by external information or internal changes, the behavior-production object can be notified of the state where an instinct is enhanced. On the basis of the information from the instinct module, the behavior-production object controls the first to fourth CPC devices 20, 30, 40, 50, which are hardware, via the system software and OS. Thus, the optimum instinctive expression corresponding to the status can be realized.

As is described above, both the emotion module and the instinct module operate on the basis of the information from the various objects, but they are controlled independently in parallel. Thus, a complicated psychological condition in which various emotions and instincts coexist can be expressed by the robot device 1 in a natural way.

The robot device 1 also has a learning function. That is, emotion parameters and instinct parameters, which are elements for changing the emotion level of each emotion unit and the instinct level of each instinct unit, are stored in the storage device 200, as described above. In the case where the robot device 1 itself learns and grows, the character and behavior can be changed as the learning object rewrites various parameters in the storage device 200.

Also, the robot device 1 can communicate with another robot device 1A, not shown, via the communication device 300.

Specifically, the emotion module of the robot device 1 notifies the communication device 300 (e.g., a radio communication card) of the information of the emotion unit of the highest emotion level. The communication device 300 transmits the information of this emotion unit through radio communication to the other robot device 1A that is designated in advance. Thus, the other robot device 1A can read the emotion of the robot device 1, and communication with emotions can be realized between the robot device 1 and the other robot device 1A.

Figure 9:
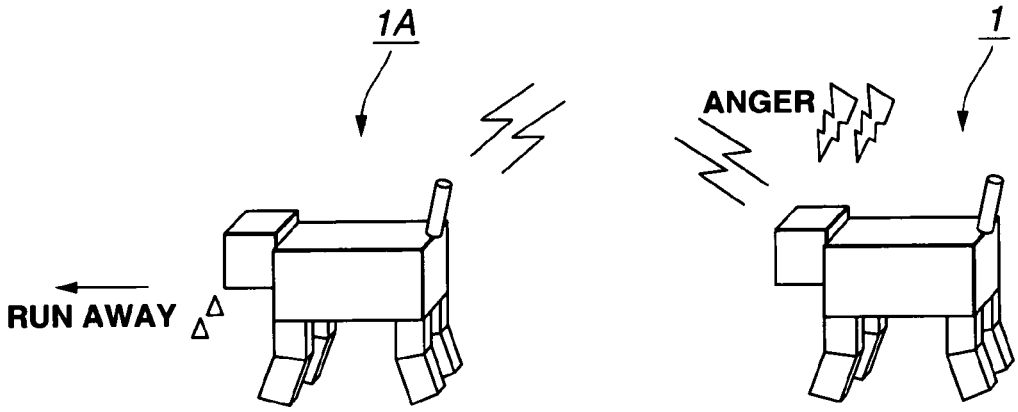
FIG. 9 illustrates the state where the robot device is communicating with another robot device.

For example, if the robot device 1 is angry, the other robot device 1A can behave accordingly. Specifically, when the robot device 1 determines that the other robot device 1A is breaking into the territory of the robot device 1, the robot device 1 behaves on the basis of anger and takes an action, such as barking, as shown in FIG. 9. In response to this, the emotion level of the emotion unit of anger of the robot device 1 is increased. In this case, the emotion level of the emotion unit of anger is transmitted from the communication device 300 of the robot device 1 to the other robot device 1A.

The other robot device 1A, having received the emotion of anger of the robot device 1, takes the action of running away in response thereto, as shown in FIG. 9. The action of running away of the other robot device 1A is taken as the emotion level of the emotion of horror or surprise of the other robot device 1A is increased in response to the emotion of anger transmitted from the robot device 1.

In this manner, the communication with emotions between the robot device 1 and the other robot device 1A and the corresponding behaviors can be taken. However, such behaviors are not limited to the above-described behaviors.

For example, if the robot device 1 is delighted, the other robot device 1A can behave delightedly in response thereto. Specifically, the other robot device 1A, having received the emotion of delight of the robot device 1, has its own emotion level of delight enhanced in response to the emotion of delight transmitted from the robot device 1 and behaves delightedly together with the robot device 1.

The information of the instinct units can be similarly transmitted from the robot device 1 to the other robot device 1A. Thus, communication between the robot devices can be realized with respect to the information of the instinct units.

Figure 10:
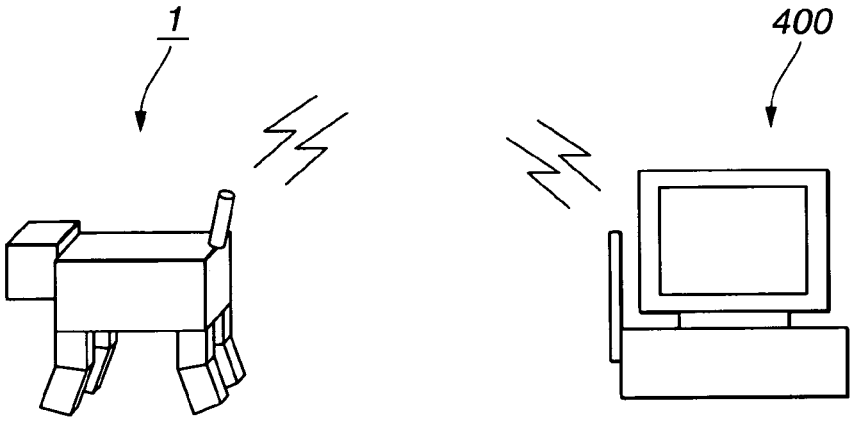
FIG. 10 illustrates the state where a personal computer controls the emotion and action of the robot device.

Moreover, not only the communication between the robot devices but also the communication between the robot device and a personal computer (PC) 400 may be carried out, as shown in FIG. 10. That is, the PC can control the output of the emotion module of the robot device 1 so as to make the robot device 1 behave in response to the emotion.

Wired communication also may be carried out as well as radio communication. As a matter of course, the information of the emotion units in the robot device 1 may be recorded on a recording medium, such as a memory card, which can be loaded into the other robot device 1A.

The robot device 1 can communicate with an electronic pet in a virtual pet device described in the Japanese Patent Application No. H10-030793, as long as it has the same interface.

In addition, in order to operate the robot device 1 of the above-described hardware structure, a recording medium, such as a memory card, may be loaded into the robot device 1 so as to install therein a control program recorded on the recording medium. The control program recorded on the recording medium may be a control program configured by an OS, system software, middleware and a application, as shown in FIG. 2.

INDUSTRIAL APPLICABILITY

With the robot device, the control method for a robot device and the program recording medium according to the present invention, an emotion is outputted as a plurality of emotion units representing various emotions of the object-oriented design affect one another, and the robot device acts on the basis of the outputted emotion. Thus, it can behave naturally like a living body having reality and a sense of living.

The invention claimed is:

1. A robot device comprising:

an emotion module in which a plurality of emotion units representing various emotions affect one another to output an emotion;

action means for acting on the basis of the emotion outputted by the emotion module; and a plurality of objects each being designed by an object-oriented design corresponding to the behaviors of a living body, wherein:

the emotion module outputs an emotion as the plurality of emotion units affect one another on the basis of information from the plurality of objects, and the plurality of objects affects one another and affects the emotion from the emotion module so as to output the information.

2. The robot device as claimed in claim 1, wherein the emotion units are designed by an object-oriented design.

3. The robot device as claimed in claim 1, wherein the action means includes a plurality of objects each being designed by an object-oriented design corresponding to the means for the behaviors of the living body.

4. The robot device as claimed in claim 1, wherein the emotion module outputs information of an emotion unit having the highest emotion level as the emotion of the plurality of emotion units having affected one another.

5. The robot device as claimed in claim 4, wherein the respective emotion units of the emotion module affect one another with the lapse of time.

6. The robot device as claimed in claim 4, wherein the respective emotion units of the emotion module affect one another on the basis of external information.

7. The robot device as claimed in claim 1, further comprising storage means for storing a plurality of parameters for controlling the state of emotion of each emotion unit, wherein the emotion module controls the state of emotion of each emotion unit on the basis of each parameter stored in the storage means.

8. The robot device as claimed in claim 1, further comprising transmission/reception means for transmitting an emotion outputted by the emotion module and/or receiving an emotion from outside and for notifying the action means of the emotion.

9. The robot device as claimed in claim 8, wherein the robot device behaves in accordance with the emotion of another robot device received by the transmission/reception means.

10. The robot device as claimed in claim 9, wherein the emotion module changes the state of emotion of the emotion unit in accordance with the emotion of another robot device.

11. The robot device as claimed in claim 1, further comprising an instinct module for outputting an instinct as a plurality of instinct units representing various instincts that change their respective instinct levels, wherein the emotion module and the instinct module operate independently while affecting the plurality of objects, and the action means acts on the basis of the output from the emotion module and the instinct module.

12. A control method for a robot device comprising:

an emotion-output step of outputting an emotion as a plurality of emotion units representing various emotions affect one another; and an action-control step of controlling the action of the robot device on the basis of the emotion outputted at the emotion-output step; wherein:

at the emotion-output step, the plurality of emotion units affect one another to output an emotion on the basis of information from a plurality of objects each being designed by an object-oriented design corresponding to the behaviors of a living body, and the plurality of objects affects one another and affects the emotion from the emotion-output step so as to output the information.

13. The control method for a robot device as claimed in claim 12, wherein the emotion units are designed by an object-oriented design.

14. The control method for a robot device as claimed in claim 12, wherein at the emotion-output step, information of an emotion unit having the highest emotion level is outputted as the emotion of the plurality of emotion units having affected one another.

15. The control method for a robot device as claimed in claim 14, wherein at the emotion-output step, the respective emotion units of the emotion module affect one another on the basis of external information.

16. The control method for a robot device as claimed in claim 14, wherein at the emotion-output step, the respective emotion units of the emotion module affect one another with the lapse of time.

17. The control method for a robot device as claimed in claim 12, wherein at the emotion-output step, the state of emotion of each emotion unit is controlled on the basis of a parameter for controlling the state of emotion of each emotion unit.

18. The control method for a robot device as claimed in claim 12, wherein the emotion of another robot device outputted by said another robot device is received and a behaviors corresponding to the emotion of said another robot device is taken.

19. The control method for a robot device as claimed in claim 18, wherein at the emotion-output step, the state of emotion of the emotion unit is changed in response to the emotion of said another robot device.

20. The control method for a robot device as claimed in claim 12, further comprising an instinct output step of outputting an instinct as a plurality of instinct units representing various instincts that change their respective instinct levels, wherein at the emotion-output step and the instinct output step, the emotion and the instinct are affected by the plurality of objects and are independently outputted, and at the action-control step, the action of the robot device is controlled on the basis of the emotion and the instinct outputted at the emotion-output step and the instinct output step.

21. A program recording medium having recorded therein a program for carrying out:

an emotion-output step of outputting an emotion as a plurality of emotion units representing various emotions that affect one another; and an action-control step of controlling the action of the robot device on the basis of the emotion outputted at the emotion-output step, wherein:

at the emotion-output step, the plurality of emotion units affect one another to output an emotion on the basis of information from a plurality of objects each being designed by an object-oriented design corresponding to the behaviors of a living body, and the plurality of objects affects one another and affects the emotion from the emotion-output step so as to output the information.

22. The program recording medium as claimed in claim 21, wherein the emotion units are designed by an object-oriented design.

23. The program recording medium as claimed in claim 21, wherein at the emotion-output step, information of an emotion unit having the highest emotion level is outputted as the emotion of the plurality of emotion units having affected one another.

24. The program recording medium as claimed in claim 23, wherein at the emotion-output step, the respective emotion units of the emotion module affect one another on the basis of external information.

25. The program recording medium as claimed in claim 23, wherein at the emotion-output step, the respective emotion units of the emotion module affect one another with the lapse of time.

26. The program recording medium as claimed in claim 21, wherein at the emotion-output step, the state of emotion of each emotion unit is controlled on the basis of a parameter for controlling the state of emotion of each emotion unit.

27. The program recording medium as claimed in claim 21, wherein the emotion of another robot device outputted by said another robot device is received and a behavior corresponding to the emotion of said another robot device is taken.

28. The program recording medium as claimed in claim 27, wherein at the emotion-output step, the state of emotion of the emotion unit is changed in response to the emotion of said another robot device.

29. The program recording medium as claimed in claim 21, further comprising an instinct output step of outputting an instinct as a plurality of instinct units representing various instincts that change their respective instinct levels, wherein at the emotion-output step and the instinct output step, the emotion and the instinct are affected by the plurality of objects and are independently outputted, and at the action-control step, the action of the robot device is controlled on the basis of the emotion and the instinct outputted at the emotion-output step and the instinct output step.

30. A robot device comprising:

an instinct module in which a plurality of instinct units representing various instincts output individual instincts;

action means for acting on the basis of the instinct outputted by the instinct module; and a plurality of objects each being designed by an object-oriented design corresponding to the behaviors of a living body, wherein:

the plurality of instinct units of the instinct module output an instinct on the basis of information from the plurality of objects, and the plurality of objects affects one another and affects the instinct from the instinct module so as to output the information.

31. The robot device as claimed in claim 30, wherein the instinct units are designed by an object-oriented design.

32. The robot device as claimed in claim 30, wherein the action means includes a plurality of objects each being designed by an object-oriented design corresponding to means for the behaviors of the living body.

33. The robot device as claimed in claim 30, wherein the instinct module outputs information of an instinct unit having the highest instinct level as the instinct.

34. The robot device as claimed in claim 33, wherein the instinct module outputs the instinct on the basis of external information.

35. The robot device as claimed in claim 33, wherein the respective instinct units of the instinct module output the instinct with the lapse of time.

36. The robot device as claimed in claim 30, further comprising storage means for storing a plurality of parameters for controlling the state of instinct of each instinct unit, wherein the instinct module controls the state of instinct of each instinct unit on the basis of each parameter stored in the storage means.

37. The robot device as claimed in claim 30, further comprising transmission/reception means for transmitting an instinct outputted by the instinct module and/or receiving an instinct from outside and for notifying the action means of the instinct.

38. The robot device as claimed in claim 37, wherein the robot device behaves in accordance with the instinct of another robot device received by the transmission/reception means.

39. The robot device as claimed in claim 38, wherein the instinct module changes the state of instinct of the instinct unit in accordance with the instinct of another robot device.

40. The robot device as claimed in claim 30, further comprising an emotion module for outputting an emotion as a plurality of emotion units representing various emotions that change their respective emotion levels, wherein the instinct module and the emotion module operate independently while affecting the plurality of objects, and the action means acts on the basis of the output from the instinct module and the emotion module.

41. A control method for a robot device comprising:

an instinct output step of outputting an instinct as a plurality of instinct units representing various instincts that affect one another; and an action-control step of controlling the action of the robot device on the basis of the instinct outputted at the instinct output step, wherein:

at the instinct output step, the plurality of instinct units output an instinct on the basis of information from a plurality of objects each being designed by an object-oriented design corresponding to the behaviors of a living body, and the plurality of objects affects one another and affects the instinct from the instinct output step so as to output the information.

42. The control method for a robot device as claimed in claim 41, wherein the instinct units are designed by an object-oriented design.

43. The control method for a robot device as claimed in claim 41, wherein at the instinct output step, information of an instinct unit having the highest instinct level is outputted as the instinct.

44. The control method for a robot device as claimed in claim 43, wherein at the instinct output step, an instinct is outputted on the basis of external information.

45. The control method for a robot device as claimed in claim 43, wherein at the instinct output step, the respective instinct units output an instinct with the lapse of time.

46. The control method for a robot device as claimed in claim 41, wherein at the instinct output step, the state of instinct of each instinct unit is controlled on the basis of a parameter for controlling the state of instinct of each instinct unit.

47. The control method for a robot device as claimed in claim 41, wherein the instinct of another robot device outputted by said another robot device is received and a behavior corresponding to the instinct of said another robot device is taken.

48. The control method for a robot device as claimed in claim 47, wherein at the instinct output step, the state of instinct of the instinct unit is changed in response to the instinct of said another robot device.

49. The control method for a robot device as claimed in claim 41, further comprising an emotion-output step of outputting an emotion as a plurality of emotion units representing various emotions that change their respective emotion levels, wherein at the instinct output step and the emotion-output step, the instinct and the emotion are affected by the plurality of objects and are independently outputted, and at the action-control step, the action of the robot device is controlled on the basis of the instinct and the emotion outputted at the instinct output step and the emotion-output step.

50. A program recording medium having recorded therein a program for carrying out:

an instinct output step of outputting an instinct as a plurality of instinct units representing various instincts that affect one another; and an action-control step of controlling the action of the robot device on the basis of the instinct outputted at the instinct output step, wherein:

at the instinct output step, the plurality of instinct units output an instinct on the basis of information from a plurality of objects each being designed by an object-oriented design corresponding to the behaviors of a living body, and the plurality of objects affects one another and affects the instinct from the instinct output step so as to output the information.

51. The program recording medium as claimed in claim 50, wherein the instinct units are designed by an object-oriented design.

52. The program recording medium as claimed in claim 50, wherein at the instinct output step, information of an instinct unit having the highest instinct level is outputted as the instinct.

53. The program recording medium as claimed in claim 52, wherein at the instinct output step, an instinct is outputted on the basis of external information.

54. The program recording medium as claimed in claim 52, wherein at the instinct output step, the respective instinct units output an instinct with the lapse of time.

55. The program recording medium as claimed in claim 50, wherein at the instinct output step, the state of instinct of each instinct unit is controlled on the basis of a parameter for controlling the state of instinct of each instinct unit.

56. The program recording medium as claimed in claim 50, wherein the instinct of another robot device outputted by said another robot device is received and a behavior corresponding to the instinct of said another robot device is taken.

57. The program recording medium as claimed in claim 56, wherein at the instinct output step, the state of instinct of the instinct unit is changed in response to the instinct of said another robot device.

58. The program recording medium as claimed in claim 50, further comprising an emotion-output step of outputting an emotion as a plurality of emotion units representing various emotions change their respective emotion levels, wherein at the instinct output step and the emotion-output step, the instinct and the emotion are affected by the plurality of objects and are independently outputted, and at the action-control step, the action of the robot device is controlled on the basis of the instinct and the emotion outputted at the instinct output step and the emotion-output step.

59. A robot device comprising:

an emotion module in which a plurality of emotion units representing emotions output individual emotions;

an instinct module in which a plurality of instinct units representing instincts outputs individual instincts;

action means for acting on the basis of the emotion outputted by the emotion module and the instinct outputted by the instinct module; and a plurality of objects designed by an object-oriented design corresponding to the behaviors of a living body, wherein:

the emotion module outputs an emotion on the basis of information from the plurality of objects, the instinct module outputs an instinct on the basis of information from the plurality of objects, and the plurality of objects affects one another and affects the emotion from the emotion module and the instinct from the instinct module so as to output the information.

60. The robot device as claimed in claim 59, wherein the emotion units are affected by an instinct outputted by the instinct module, and the instinct units are affected by an emotion outputted by the emotion module.

61. The robot device as claimed in claim 60, wherein the action means includes a plurality of objects each being designated by an object-oriented design corresponding to means for the behaviors of a living body.

62. The robot device as claimed in claim 59, wherein the plurality of emotion units affects one another to output an emotion.

63. The robot device as claimed in claim 59, wherein the emotion units and the instinct units are designated by an object-oriented design.

64. The robot device as claimed in claim 59, wherein the emotion module outputs information of an emotion unit having a high emotion level as the emotion, and the instinct module outputs information of an instinct unit having a high instinct level as the instinct.

65. A control method for a robot device comprising:

an emotion-output step of outputting individual emotions by a plurality of emotion units representing emotions;

an instinct output step of outputting individual instincts by a plurality of instinct units representing instincts; and an action-control step of controlling the action of the robot device on the basis of the emotion outputted at the emotion-output step and the instinct outputted at the instinct output step, wherein:

at the emotion-output step, an emotion is outputted on the basis of information from a plurality of objects each being designated by an object-oriented design corresponding to the behaviors of a living body, at the instinct output step, an instinct is outputted on the basis of information from a plurality of objects each being designated by an object-oriented design corresponding to the behaviors of a living body, and the plurality of objects affects one another and affects the emotion from the emotion module and the instinct from the instinct module so as to output the information.

66. The control method for a robot device as claimed in claim 65, wherein the emotion units are affected by an instinct outputted at the instinct output step, and the instinct units are affected by an emotion outputted at the emotion-output step.

67. The control method for a robot device as claimed in claim 65, wherein the plurality of emotion units affects one another to output an emotion.

68. The control method for a robot device as claimed in claim 65, wherein the emotion units and the instinct units are designated by an object-oriented design.

69. The control method for a robot device as claimed in claim 65, wherein at the emotion-output step, information of an emotion unit having a high emotion level is outputted as the emotion, and at the instinct output step, information of an instinct unit having a high instinct level is outputted as the instinct.

70. A program recording medium having recorded therein a program for carrying out:

an emotion-output step of outputting individual emotions by a plurality of emotion units representing emotions;

an instinct output step of outputting individual instincts by a plurality of instinct units representing instincts; and an action-control step of controlling the action of the robot device on the basis of the emotion outputted at the emotion-output step and the instinct outputted at the instinct output step, wherein:

the emotion units are affected by an instinct outputted at the instinct output step, the instinct units are affected by an emotion outputted at the emotion-output step, at the emotion-output step, an emotion is outputted on the basis of information from a plurality of objects each being designated by an object-oriented design corresponding to the behaviors of a living body, and at the instinct output step, an instinct is outputted on the basis of information from a plurality of objects each being designated by an object-oriented design corresponding to the behaviors of a living body, the plurality of objects affecting one another and affecting the emotion from the emotion module and the instinct from the instinct module so as to output the information.

71. The program recording medium as claimed in claim 70, wherein the plurality of emotion units affects one another to output an emotion.

72. The program recording medium as claimed in claim 70, wherein the emotion units and the instinct units are designated by an object-oriented design.

73. The program recording medium as claimed in claim 70, wherein at the emotion-output step, information of an emotion unit having a high emotion level is outputted as the emotion, and at the instinct output step, information of an instinct unit having a high instinct level is outputted as the instinct.

74. A robot device comprising:

detection means for detecting a stimulus applied from outside;

storage means for storing the record of information related to the stimulus;

response processing decision means for deciding response processing on the basis of the stimulus detected by the detection means; and response execution means for executing the response processing decided by the response processing decision means;

wherein the response processing decision means decides the response processing on the basis of the record information stored in the storage means, wherein the response processing decision means is an emotion module for deciding an emotion in response to an emotion level, which is the record information, changing in response to the stimulus due to an emotion, and the response execution means takes a behavior and/or an action for expressing the emotion decided by the emotion module.

75. A robot device comprising:

detection means for detecting a stimulus applied from outside;

storage means for storing the record of information related to the stimulus;

response processing decision means for deciding response processing on the basis of the stimulus detected by the detection means; and response execution means for executing the response processing decided by the response processing decision means;

wherein the response processing decision means decides the response processing on the basis of the record information stored in the storage means, wherein the response processing decision means is an instinct module for deciding an instinct in response to an instinct level, which is the record information, changing in response to the stimulus due to an instinct, and the response execution means takes a behavior and/or an action for expressing the instinct decided by the instinct module.

76. A control method for robot device comprising:

a detection step of detecting a stimulus applied to the robot device from outside;

a response processing decision step of deciding response processing of the robot device on the basis of the stimulus detected at the detection step;

a response execution step of causing the robot device to execute the response processing decided at the response processing decision step; and wherein at the response processing decision step, the response processing is decided on the basis of the record information stored in storage means, wherein the response processing decision means is an emotion module for deciding an emotion in response to an emotion level, which is the record information, changing in response to the stimulus due to an emotion, and the response execution means causes the robot device to take a behavior and/or an action for expressing the emotion decided by the emotion module.

77. A control method for robot device comprising:

a detection step of detecting a stimulus applied to the robot device from outside;

a response processing decision step of deciding response processing of the robot device on the basis of the stimulus detected at the detection step;

a response execution step of causing the robot device to execute the response processing decided at the response processing decision step; and wherein at the response processing decision step, the response processing is decided on the basis of the record information stored in storage means, wherein the response processing decision means is an instinct module for deciding an instinct in response to an instinct level, which is the record information, changing in response to the stimulus due to an instinct, and the response execution means causes the robot device to take a behavior and/or an action for expressing the instinct decided by the instinct module.

78. A program recording medium having recorded therein a program for carrying out:

a detection step of detecting a stimulus applied to a robot device from outside;

a response processing decision step of deciding the response processing of the robot device on the basis of the stimulus detected at the detection step; and a response execution step of causing the robot device to execute the response processing decided at the response processing decision step;

wherein at the response processing decision step, the response processing is decided on the basis of the record information stored in storage means, wherein the response processing decision means is an emotion module for deciding an emotion in response to an emotion level, which is the record information, changing in response to the stimulus due to an emotion, and the response execution means causes the robot device to take a behavior and/or an action for expressing the emotion decided by the emotion module.

79. A program recording medium having recorded therein a program for carrying out:

a detection step of detecting a stimulus applied to a robot device from outside;

a response processing decision step of deciding the response processing of the robot device on the basis of the stimulus detected at the detection step; and a response execution step of causing the robot device to execute the response processing decided at the response processing decision step;

wherein at the response processing decision step, the response processing is decided on the basis of the record information stored in storage means, wherein the response processing decision means is an instinct module for deciding an instinct in response to an instinct level, which is the record information, changing in response to the stimulus due to an instinct, and the response execution means causes the robot device to take a behavior and/or an action for expressing the instinct decided by the instinct module.

80. A robot device having a multi-joint driving unit, comprising:

means for holding a recognition object constructed by an object-oriented design, the recognition object being adapted to recognize input information and notify of a result of recognition;

means for holding an emotion model object constructed by an object-oriented design, the emotion model object having the result of recognition of the recognition object inputted thereto and being adapted to change an emotion level in accordance with the input information; and means for holding an action generation object constricted by an object-oriented design, the action generation object being adapted to cause the robot device to act by controlling the multi-joint driving unit on the basis of information from the emotion model object.

81. A robot device having a multi-joint driving unit, comprising:

means for holding a recognition object constricted by an object-oriented design, the recognition object being adapted to recognize an internal state and notify of a result of recognition;

means for holding an instinct model object constructed by an object-oriented design, the instinct model object having the result of recognition of the recognition objectinputted thereto and being adapted to change an instinct level in accordance with the input information; and means for holding an action generation object constructed by an object-oriented design, the action generation object being adapted to cause the robot device to act by controlling the multi-joint driving unit on the basis of information from the instinct model object.

82. An action control method for a robot device having a multi-joint driving unit, the method comprising:

a step of notifying an emotion model object constructed by an object-oriented design, of a result of recognition from a recognition object constructed by an object oriented design and adapted to recognize input information;

a step of changing an emotion level in accordance with the information of the result of recognition of the recognition object inputted to the emotion model object; and a step of causing the robot device to act by controlling the multi-joint driving unit by an action generation object constructed by an object-oriented design on the basis of information from the emotion model object.

83. An action control method for a robot device having a multi-joint driving unit, the method comprising:

a step of notifying an instinct model object constructed by an object-oriented design, of a result of recognition from a recognition object constructed by an object oriented design and adapted to recognize an internal state;

a step of changing an instinct level in accordance with the information of the result of recognition of the recognition object inputted to the instinct model object; and a step of causing the robot device to act by controlling the multi-joint driving unit by an action generation object constructed by an object-oriented design on the basis of information from the instinct model object.

84. A recording medium in which a program for controlling an action of a robot device having a multi-joint driving unit is recorded, the program being adapted, for executing:

a step of notifying an emotion model object constructed by an object-oriented design, of a result of recognition from a recognition object constructed by an object oriented design and adapted to recognize input information;

a step of changing an emotion level in accordance with the information of the result of recognition of the recognition object inputted to the emotion model object; and a step of causing the robot device to act by controlling the multi-joint driving unit by an action generation object constructed by an object-oriented design on the basis of information from the emotion model object.

85. A recording medium in which a program for controlling an action of a robot device having a multi-joint driving unit is recorded, the program being adapted to execute:

a step of notifying an instinct model object constructed by an object-oriented design, of a result of recognition from a recognition object constructed by an object oriented design and adapted to recognize an internal state;

a step of changing an instinct level in accordance with the information of the result of recognition of the recognition object inputted to the instinct model object; and a step of causing the robot device to act by controlling the multi-joint driving unit by an action generation object constructed by an object-oriented design on the basis of information from the instinct model object.

86. A robot device having a multi-joint driving unit, comprising:

external state detection means for detecting an external state;

an emotion module having a value changing on the basis of the detected external state;

action generation control means for controlling the multi-joint driving unit on the basis of the value of the emotion module; and communication means for receiving a value of an emotion module of another robot device;

wherein the value of the emotion module of the robot device changes on the basis of the value of the emotion module of said another robot device received by the communication means.

87. A robot device having a multi-joint driving unit, comprising:

external state detection means for detecting an external state;

an emotion module having a value changing on the basis of the detected external state;

action generation control means for controlling the multi-joint driving unit on the basis of the value of the emotion module; and communication means for receiving a value of an emotion module of another robot device;

wherein the action generation control means generates a predetermined action on the basis of the value of the emotion module of said another robot device received by the communication means.

88. An action control method for a robot device for controlling an action of a robot device having a multi-joint driving unit, the method comprising:

an external state detection step of detecting an external state;

a value change step of changing a value of an emotion module on the basis of the detected external state;

an action generation control step of controlling the multi-joint driving unit on the basis of the changed value of the emotion module; and a reception step of receiving a value of an emotion module of another robot device by communication means;

wherein the value of the emotion module of the robot device changes on the basis of the value of the emotion module of said another robot device received by the communication means.

89. An action control method for a robot device for controlling an action of a robot device having a multi-joint driving unit, the method comprising:

an external state detection step of detecting an external state;

a value change step of changing a value of an emotion module on the basis of the detected external state;

an action generation control step of controlling the multi-joint driving unit on the basis of the changed value of the emotion module; and a reception step of receiving a value of an emotion module of another robot device;

wherein at the action generation control step, a predetermined action is generated on the basis of the value of the emotion module of said another robot device received by the communication means.

90. A recording medium in which a program for controlling an action of a robot device having a multi-joint driving unit is recorded, the program comprising:

an external state detection step of detecting an external state of the robot device;

a value change step of changing a value of an emotion module of the robot device on the basis of the detected external state;

an action generation control step of controlling the multi-joint driving unit on the basis of the changed value of the emotion module; and a reception step of receiving a value of an emotion module of another robot device by communication means;

wherein the program controls the value of the emotion module of the robot device so that the value changes on the basis of the value of the emotion module of said another robot device received by the communication means.

91. A recording medium in which a program for controlling an action of a robot device having a multi-joint driving unit is recorded, the program comprising:

an external state detection step of detecting an external state of the robot device;

a value change step of changing a value of an emotion module of the robot device on the basis of the detected external state;

an action generation control step of controlling the multi-joint driving unit on the basis of the changed value of the emotion module; and a reception step of receiving a value of an emotion module of another robot device;

wherein the program controls so that at the action; generation control step, a predetermined action is generated on the basis of the value of the emotion module of said another robot device received by the communication means.

92. A robot having a plurality of movable parts, comprising:

means for holding a recognition object that is designed by an object-oriented design to process input information and notify of the recognition result of the processing of the input information;

means for holding an emotion module object which is designed by an object-oriented design and whose emotion level is changed in accordance with the recognition result which is inputted from the recognition object, and the emotion module object notify of the emotion level; and means for holding a behavior object which is designed by an object-oriented design to make a behavior of the robot based on the emotion level notified from the emotion module object, wherein control means for controlling the moveable parts to make the robot perform the behavior that is made by the behavior object.

93. A robot having a plurality of movable parts, comprising:

means for holding a recognition object that is designed by an object-oriented design to process input information and notify of the recognition result of the processing of the input information;

means for holding an instinct module object which is designed by an object-oriented design and whose instinct level is changed in accordance with the recognition result which is inputted from the recognition object, and the instinct module object notify of the instinct level; and means for holding a behavior object that is designed by an object-oriented design to make a behavior of the robot based on the instinct level notified from the instinct module object, wherein control means for controlling the moveable parts to make the robot perform the behavior that is made by the behavior object.

* * * * *

UNITED STATES PATENT AND TRADEMARK OFFICE

CERTIFICATE OF CORRECTION

PATENT NO. : 7,076,331 B1
APPLICATION NO. : 09/701254
DATED : July 11, 2006
INVENTOR(S) : Norio Nagatsuka et al.

It is certified that error appears in the above-identified patent and that said Letters Patent is hereby corrected as shown below:

Title Page:
Item (54) and Col. 1, line 1 should be read as follows:
-- ROBOT DEVICE, CONTROL METHOD FOR ROBOT DEVICE, AND PROGRAM RECORDING MEDIUM --.

Signed and Sealed this

Thirty-first Day of July, 2007

JON W. DUDAS
*Director of the United States Patent and Trademark Office*